US011434727B2

(12) United States Patent
Tang et al.

(10) Patent No.: US 11,434,727 B2
(45) Date of Patent: Sep. 6, 2022

(54) IN SITU EXPLOITATION-SEPARATION-BACKFILLING INTEGRATION APPARATUS USED FOR NATURAL GAS HYDRATES

(71) Applicant: Southwest Petroleum University, Chengdu (CN)

(72) Inventors: Yang Tang, Chengdu (CN); Zeliang Li, Chengdu (CN); Guorong Wang, Chengdu (CN); Qingyou Liu, Chengdu (CN); Jinhai Zhao, Chengdu (CN); Guangjie Yuan, Chengdu (CN); Jinzhong Wang, Chengdu (CN); Yufa He, Chengdu (CN); Qingping Li, Chengdu (CN); Chuanhua Ma, Chengdu (CN); Yuan Huang, Chengdu (CN)

( * ) Notice: Subject to any disclaimer, the term of this patent is extended or adjusted under 35 U.S.C. 154(b) by 0 days.

(21) Appl. No.: 17/537,437

(22) Filed: Nov. 29, 2021

(65) Prior Publication Data

US 2022/0243564 A1 Aug. 4, 2022

(30) Foreign Application Priority Data

Feb. 1, 2021 (CN) ..... 202110135335.4

(51) Int. Cl.
*E21B 41/00* (2006.01)
*E21B 43/40* (2006.01)
(Continued)

(52) U.S. Cl.
CPC ..... *E21B 41/0099* (2020.05); *E21B 43/35* (2020.05); *E21B 43/38* (2013.01); *E21B 43/40* (2013.01)

(58) Field of Classification Search
CPC ..... E21B 43/35; E21B 43/38; E21B 43/40; E21B 41/0099
See application file for complete search history.

(56) References Cited

U.S. PATENT DOCUMENTS 4,376,462 A 3/1983 Elliott et al.
6,336,504 B1 * 1/2002 Alhanati ..... E21B 43/385 166/372
(Continued)

FOREIGN PATENT DOCUMENTS

CN 202731870 U 2/2013
CN 107489412 A 12/2017
(Continued)

OTHER PUBLICATIONS

American Heritage Dictionary—Inhale—Accessed 2022 https://ahdictionary.com/word/search.html?q=inhale (Year: 2022).*

*Primary Examiner* — David Carroll

(57) ABSTRACT

An in situ exploitation-separation-backfilling integration apparatus for natural gas hydrates is disclosed, consisting of a cyclonic suction device for coarse fraction, a jet flow device for sand discharge and a spiral cyclone device for fine fraction. The cyclonic suction device for coarse fraction is provided with a vortex trough and a cyclonic auxiliary flow channel; the jet flow device for sand discharge mainly consists of a sand discharge sliding sleeve, a sand discharge jet cylinder and a spring, wherein the sand discharge sliding sleeve can control the spraying out of hydraulic fluid and it is provided with a sand discharge butting head; inside the spiral cyclone device for fine fraction is a tapered structure and its upper portion is provided with a centering bracket.

8 Claims, 9 Drawing Sheets

(51) Int. Cl.
*E21B 43/34* (2006.01)
*E21B 43/38* (2006.01)

(56) References Cited

U.S. PATENT DOCUMENTS

| | | | | |
|---|---|---|---|---|
| 2002/0134554 | A1* | 9/2002 | Schrenkel | E21B 43/38 166/372 |
| 2017/0022797 | A1* | 1/2017 | Joshi | E21B 43/385 |
| 2018/0003015 | A1* | 1/2018 | Muraikhi | E21B 43/38 |

FOREIGN PATENT DOCUMENTS

| | | | |
|---|---|---|---|
| CN | 108590622 | A | 9/2018 |
| CN | 108643869 | A | 10/2018 |
| CN | 108716361 | A | 10/2018 |
| CN | 207974803 | U | 10/2018 |
| CN | 109488262 | A | 3/2019 |
| CN | 110029983 | A | 7/2019 |
| CN | 112267854 | A | 1/2021 |

* cited by examiner

IN SITU EXPLOITATION-SEPARATION-BACKFILLING INTEGRATION APPARATUS USED FOR NATURAL GAS HYDRATES

CROSS-REFERENCE TO RELATED APPLICATIONS

This application claims priority to Chinese Application No. 202110135335.4, filed on Feb. 1, 2021, entitled "an in situ exploitation-separation-backfilling integration apparatus used for natural gas hydrates". These contents are hereby incorporated by reference.

TECHNICAL FIELD

The present invention relates to natural gas hydrate development area, more specifically an in situ exploitation-separation-backfilling integration apparatus used for natural gas hydrates.

BACKGROUND

Natural gas hydrates are also known as "flammable ice", being a unconventional clean and alternative energy with high density and higher calorific value, which exist in deepwater subsea in forms such as a sandstone type, a sandstone fracture type, a fine-grained fracture type and a dispersing type, wherein the fine-grained fracture type and the dispersing type natural gas hydrates account for the vast majority, but natural gas hydrates of such types are shallowly buried and weakly cemented and it can easily cause geological and environmental disasters during exploitation process. In addition, a bottleneck problem of large sand discharge volume exists in all the existing exploitation methods such as fluidization, which severely inhibits the development of natural gas hydrate exploitation process and technology.

The Chinese patent with a publication number CN209818045U and publication data 20 Nov. 2019 discloses a parallel device that uses a spiral separator to perform downhole separation on large amount of hydrates; the Chinese patent with a publication number CN109184658B and publication data 22 Jan. 2021 discloses an offset symmetric parallel device for in situ separation of subbottom natural gas hydrates. Thus, the prior disclosed technique merely configure the traditional cyclonic or spiral separator in the conduit parallelly and its flow channel is in a complex configuration, which will easily cause stack of cement sands and block the flow channel, not suitable for the integrated work process that efficiently performs harvest, separation, cement crushing and backfilling on natural gas hydrates. And the prior disclosed technology does not specifically configure a sand discharge mechanism, which cannot realize the efficient discharge and backfilling of cement sands.

In summary, there is an urgent need for a separation apparatus for natural gas hydrates to solve the problems in the prior art and realize the harvest, separation and backfilling integration function of performing high-efficiency cyclone, downhole in situ separation of cement sands, slurry weak cement bond breaking and cement sand discharge and backfilling on natural gas hydrate mixture slurry within the crushed cavity, which improves harvest efficiency, reduces the overall operating cost and decreases the collapse risk of crushing cavity.

SUMMARY OF THE INVENTION

The present application provides an in situ exploitation-separation-backfill integration apparatus used for natural gas hydrates in order to solve problems that cement sands block the flow channel and cement sands fails to achieve in-situ separation and backfilling. The apparatus can achieve in situ separation on solid particles such as cement sands and cement crushing on hydrates during the harvesting process of natural gas hydrates, which greatly decreases the exploitation cost of natural gas hydrates.

The present invention is realized by the following solutions:

An in situ exploitation-separation-backfilling integration apparatus used for natural gas hydrates, configured as a double-layer tube structure and comprises a cyclonic suction device for coarse fraction, a jet flow device for sand discharge and a spiral cyclone device for fine fraction as an outer layer structure as a whole, and a hydraulic fluid tube as an inner layer, where the whole jet flow device for sand discharge is located at the bottom end of the apparatus, the upper end of the jet flow device for sand discharge is connected to the cyclonic suction device for coarse fraction through screw threads, the cyclonic suction device for coarse fraction is connected to the lower end of the spiral cyclone device for fine fraction through screw thread;

the jet flow device for sand discharge comprises a sand discharge jet cylinder, a spring I, a sand discharge sliding sleeve, a spring II and a spring plate, the lower end of the sand discharge sliding sleeve is amounted with the spring I and the upper end of the sand discharge sliding sleeve is mounted with the spring II, the spring plate fixes the spring I, the sand discharge sliding sleeve and the spring II inside the sand discharge jet cylinder, the sand discharge sliding sleeve is configured to slide along the axial direction of the sand discharge jet cylinder, the bottom end of the hydraulic liquid tube is configured to be assembled in the pipeline seal ring groove of the sand discharge jet cylinder;

the cyclonic suction device for coarse fraction comprises a conical flow stabilizing rubber cylinder, a fixing ring I, a positioning sleeve, a cyclone generation plate, a fixing ring II and a cyclonic suction outer tube, the conical flow stabilizing rubber cylinder is fixed and assembled to a step of the hydraulic liquid tube through the fixing ring I, the positioning sleeve is mounted on the upper end of the fixing ring I, the cyclone generation plate is fixed and mounted to the upper end of the positioning sleeve through the fixing ring II;

the spiral cyclone device for fine fraction comprises a recovery cylinder for spirally crushed cements, a centering bracket, a fixing ring III, the centering bracket axially fixed and assembled to the inner wall of the recovery cylinder for spirally crushed cements through the fixing ring III.

The upper end of the sand discharge jet cylinder is flat adapter threads I, the lower end of the sand discharge jet cylinder is male buckle taper threads, its circumference has a sand discharge hole and its inner portion is circumferentially configured with a groove for receiving the spring and a concave cone surface adjacent to the groove, the inner layer of the sand discharge jet cylinder has a pipeline seal ring groove and its upper end is configured with a jet cylinder threaded hole.

The sand discharge sliding sleeve from the bottom up is a sliding sleeve lower conical surface at the bottom, a lower step I (302), a sand discharge butting head circumferentially configured at the sand discharge sliding sleeve, a middle step II and a sliding positioning cylinder section (305) at the uppermost end thereof. Wherein, the lower step I abuts the upper end of the spring I, the middle step II abuts the spring II, the sliding positioning cylinder section is in a clearance fit with the inner diameter of the spring plate fixed on the jet threaded holes through a bolt.

The conical flow stabilizing rubber cylinder is a hollow conic shape made of rubber material, its rubber conical surface deforms longitudinally under pressure, the lower end of the conical flow stabilizing rubber cylinder is configured with a labyrinth seal.

The upper end of the cyclone generation plate is a flow baffle and its middle portion is a through hole and a circumferentially centering plate.

The upper portion of the cyclonic suction outer tube is circumferentially configured with a vortex trough and a circumferential speed is generated when fluid flows into the vortex trough.

The outer wall of the recovery cylinder for spirally crushed cements from the bottom up is configured with a suction bowl connection threads at the lower portion, a circumferential distributed spline keyway for positioning the centering bracket at the upper portion and drill rod female buckle threads at the upper most end, its inner portion from the bottom up is configured with the following flow channels: a cyclonic auxiliary flow channel and a tapered flow channel.

In summary, beneficial effects of the present invention are:

(1) The present invention employs a vortex trough structure, which generates a circumferential speed after the natural gas hydrate is inhaled so as to separate cement sands and natural gas hydrates, whose suction port is in a simple structure without the need to configure complex flow channels, avoiding stack and block of cement sands;

(2) The jet flow device for sand discharge can directly backfill the separated cement sands into the worked-out section by using high pressure hydraulic fluid, which alleviates the throughput of stand pipes, decreases power assumption produced by pumping and transporting cement sands, increases the harvest efficiency and greatly reduces the harvest cost, avoiding erosive wear and block of cement sands on wellbore and apparatus;

(3) The present invention can realize the harvest-separation integration of natural gas hydrates, continuously exploit natural gas hydrate deposit containing large amount of sands and decreases harvest cost and operation amounts of natural gas hydrates by using the particular structures of the cyclonic suction device for coarse fraction and the sand discharge mechanism, thereby realizing the efficient exploitation of natural gas hydrates;

(4) Natural gas hydrates can effectively decompose hydrates, cement sands and water apart in the flow field formed by the cyclonic suction device for coarse fraction and the spiral cyclone device for fine fraction, which can achieve effective separation of the micron-sized minuteness cement sand solid particles with cross-scale particle size in multi-phase mixed slurry, thereby ensuring the purity of natural gas hydrates returned from the exploitation process.

Figure 1:
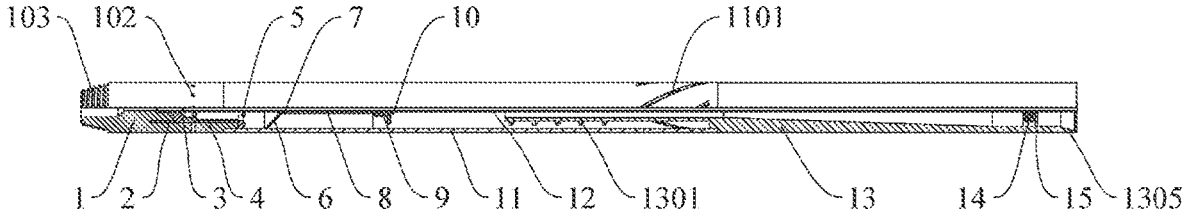
FIG. 1 is a half sectional view of the overall structure in the present disclosure.
Figure 2:
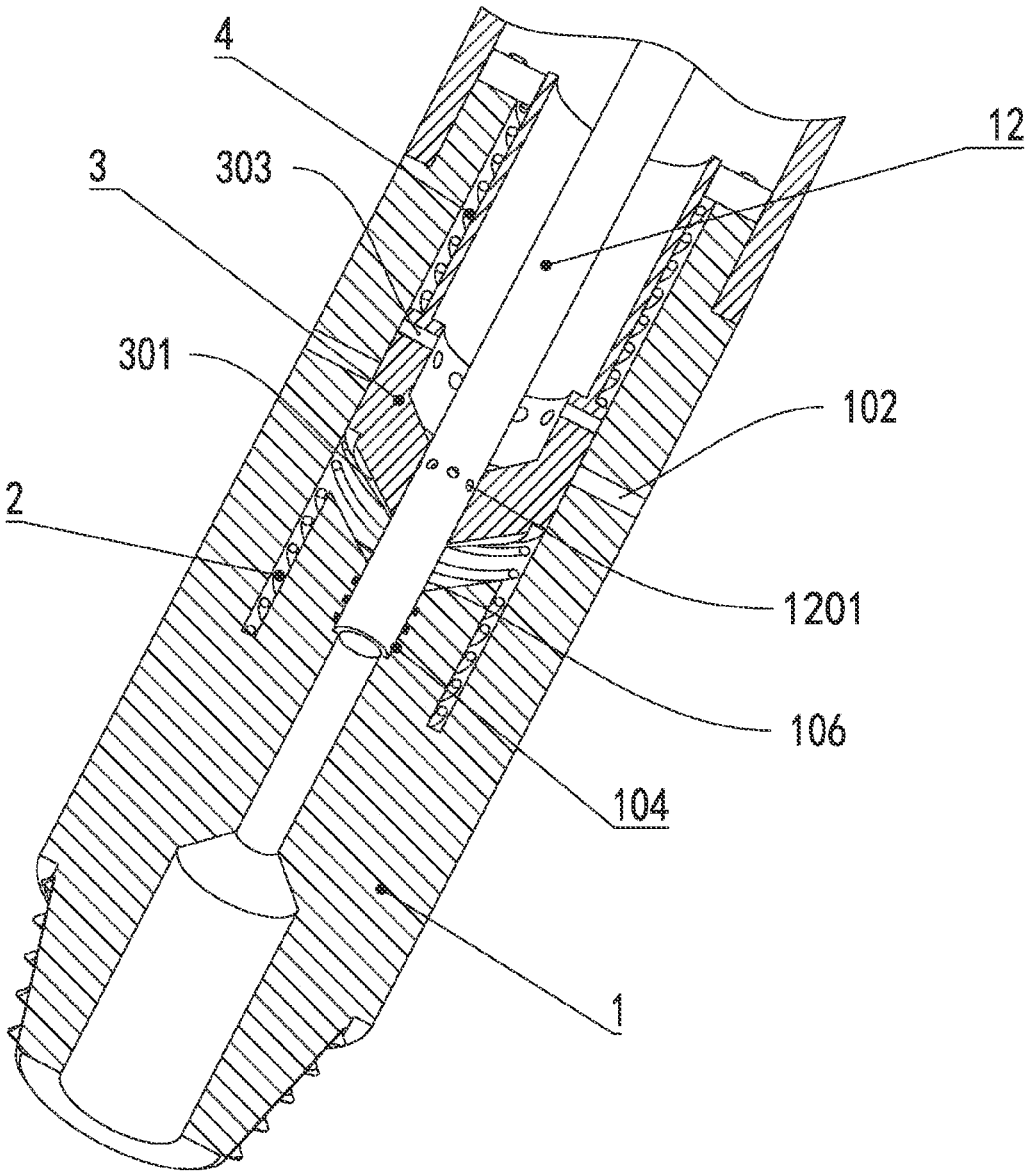
FIG. 2 is a three-dimensional sectional view of the jet flow device for sand discharge in the present disclosure.
Figure 3:
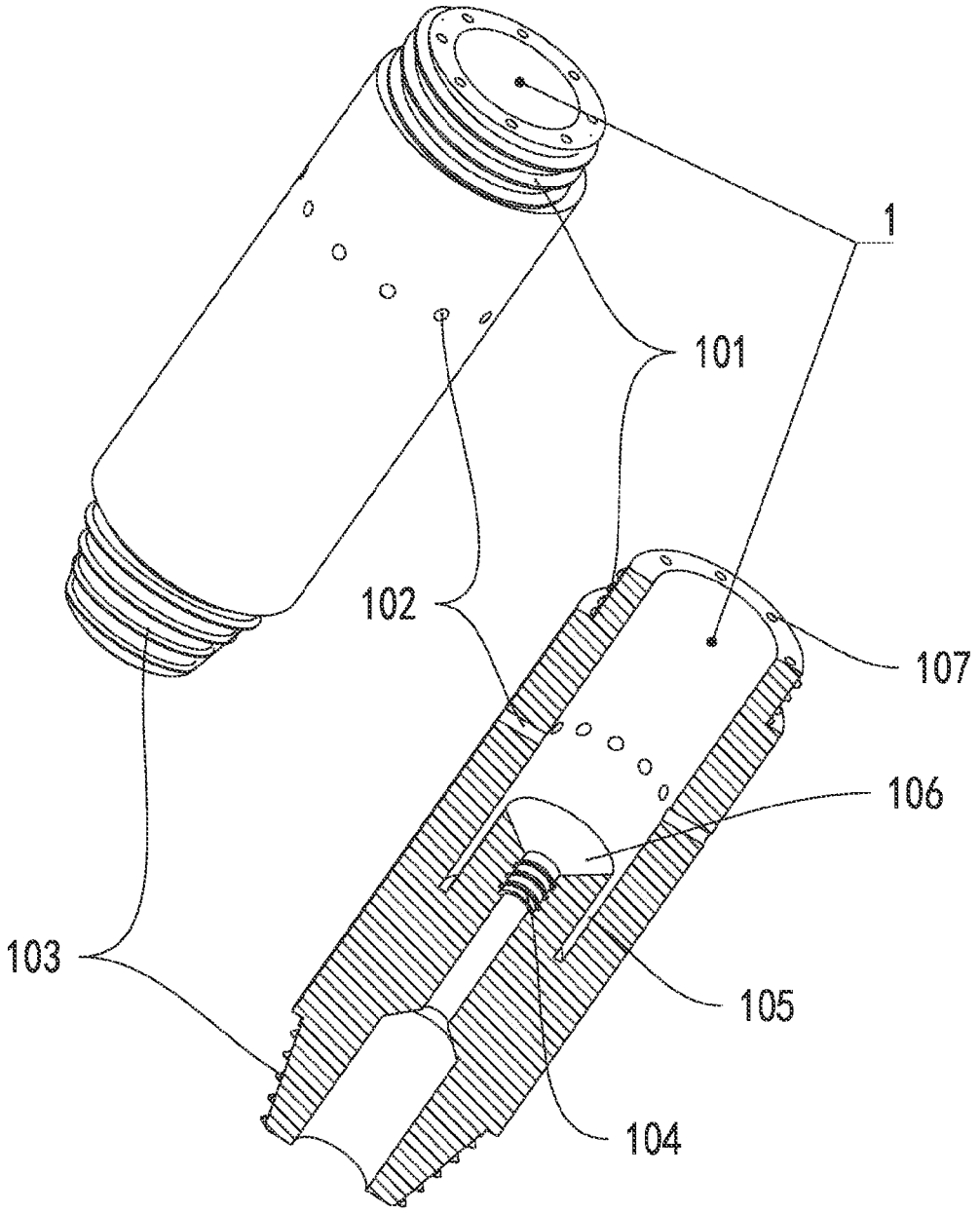
FIG. 3 is a three-dimensional schematic view of the sand discharge jet cylinder in the present disclosure.
Figure 4:
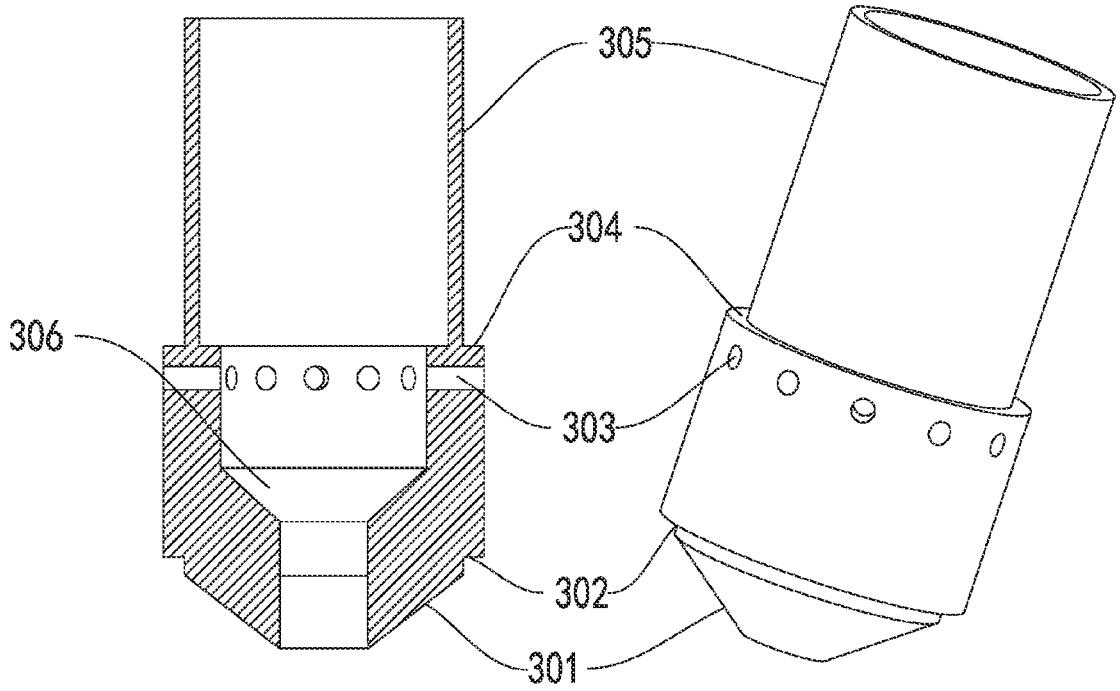
FIG. 4 is a three-dimensional schematic view of the sand discharge sliding sleeve in the present disclosure.
Figure 5:
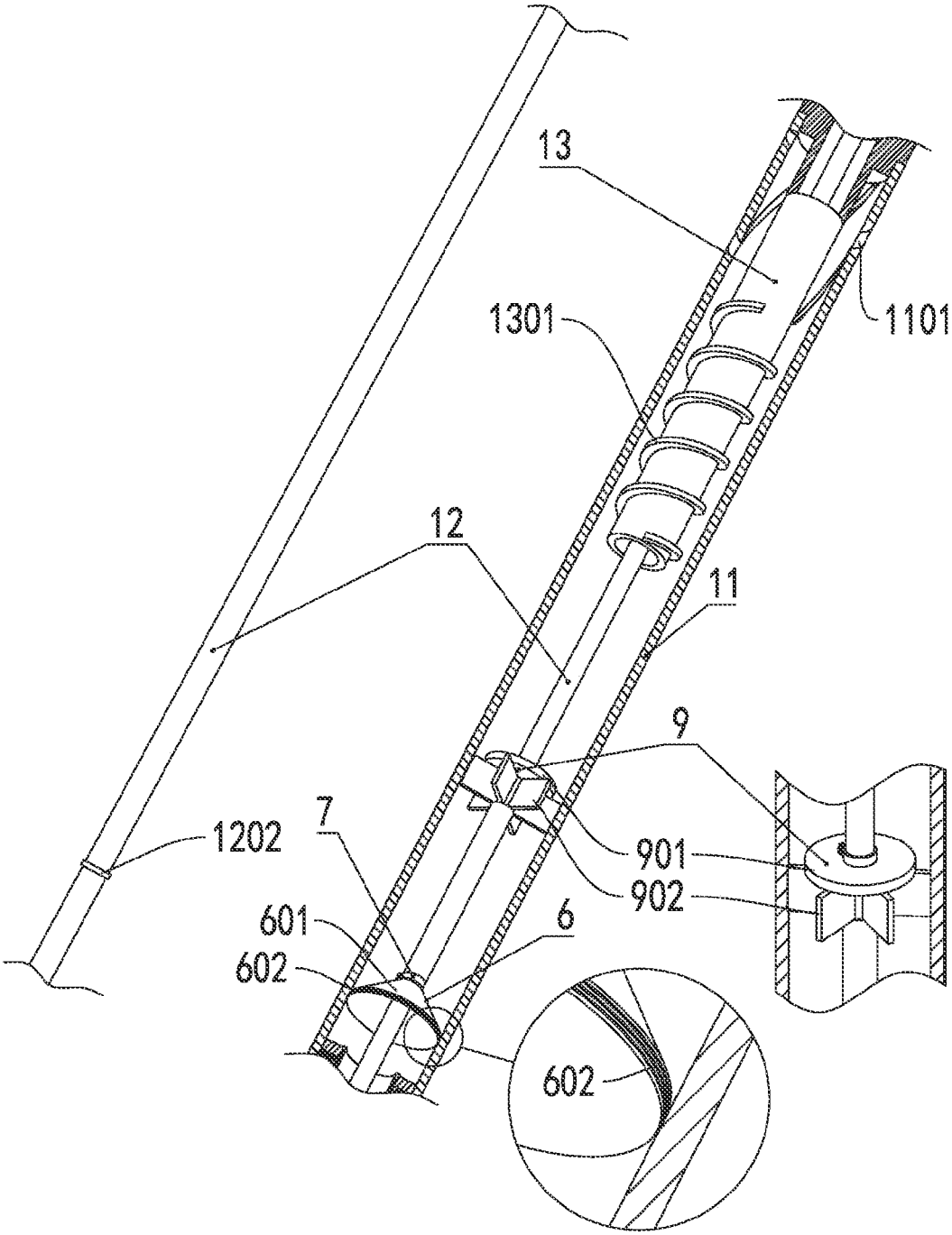
FIG. 5 is a three-dimensional sectional view of parts of the structures of the present disclosure, wherein cyclonic suction device for coarse fraction in the present disclosure is shown.
Figure 6:
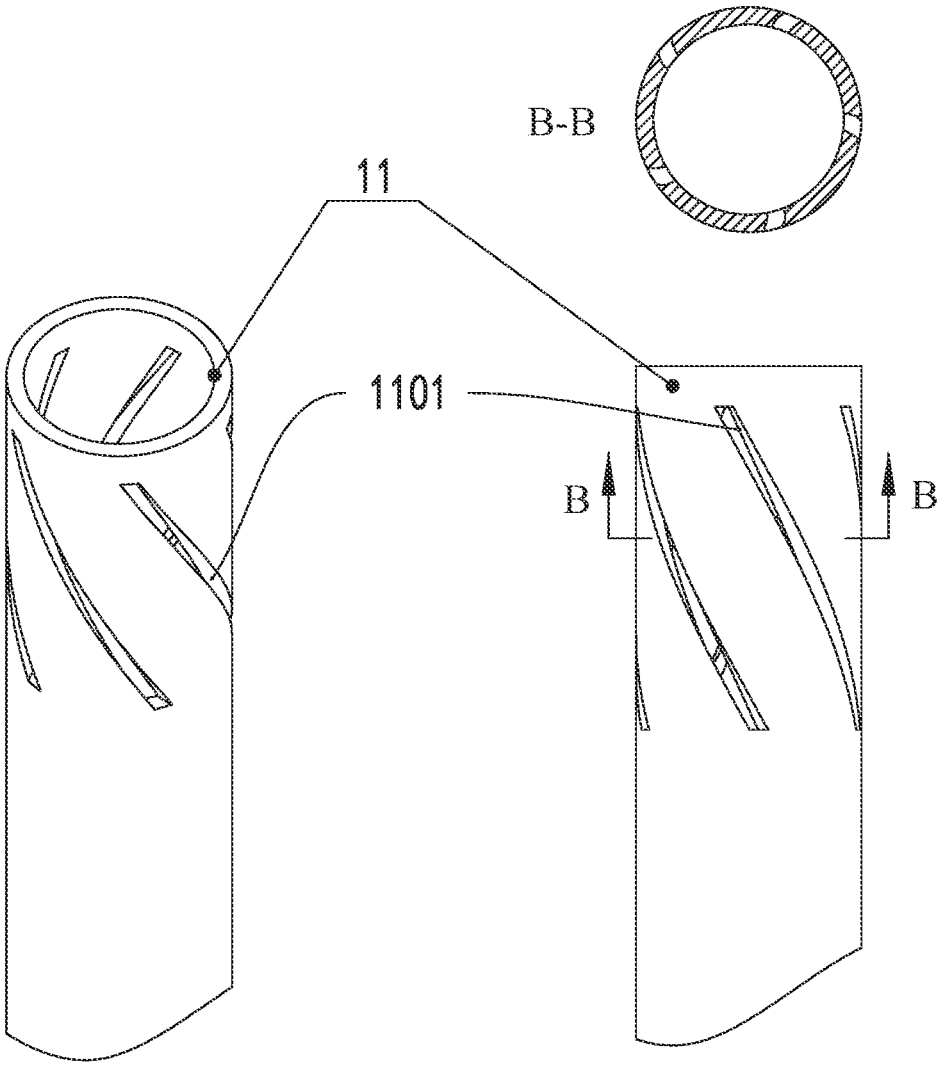
FIG. 6 is a three-dimensional schematic view of the cyclonic suction outer tube in the present disclosure.
Figure 7:
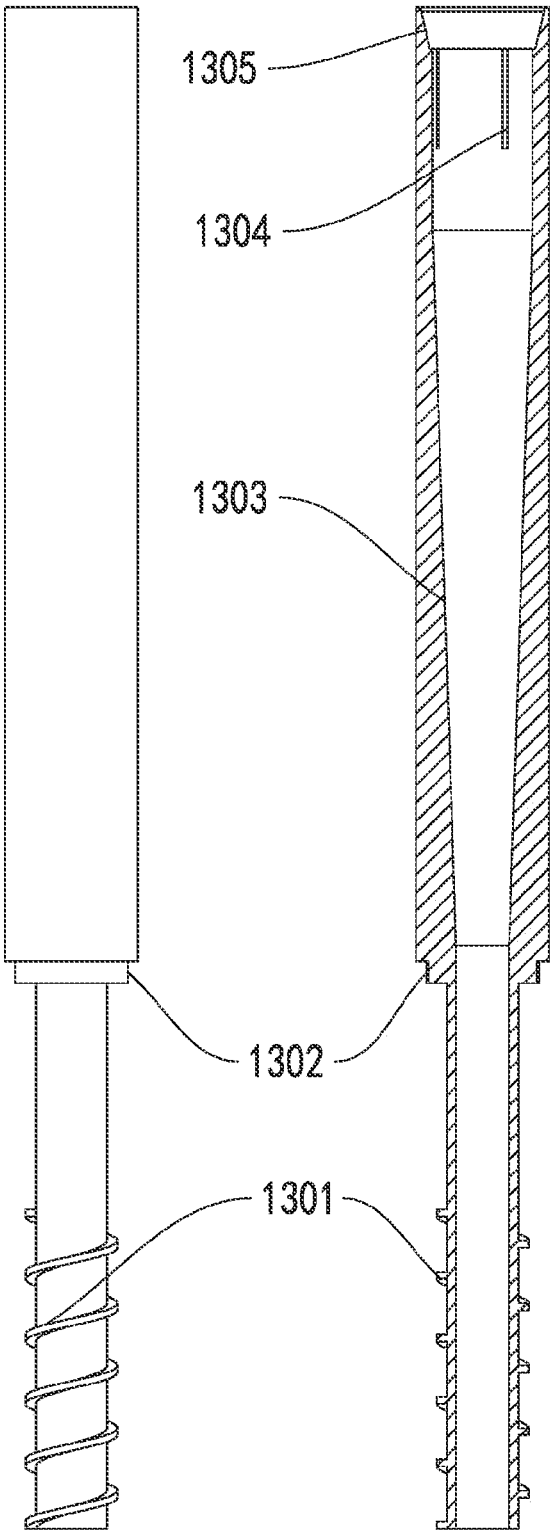
FIG. 7 is a schematic view of the recovery cylinder for spirally crushed cements in the present disclosure.
Figure 8:
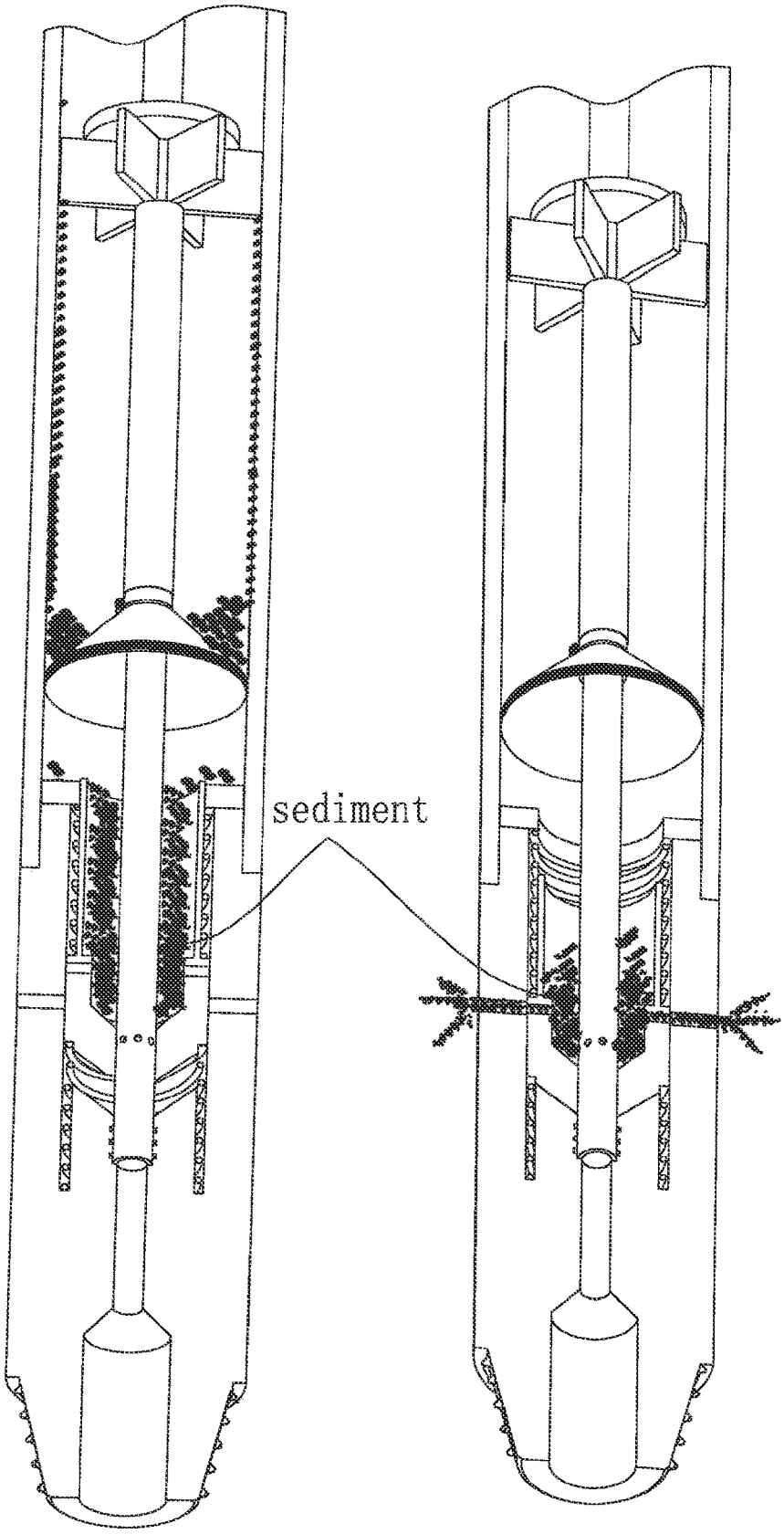
FIG. 8 is a comparative view before and after cement sands are discharged by the jet flow device for sand discharge in the present disclosure.
Figure 9:
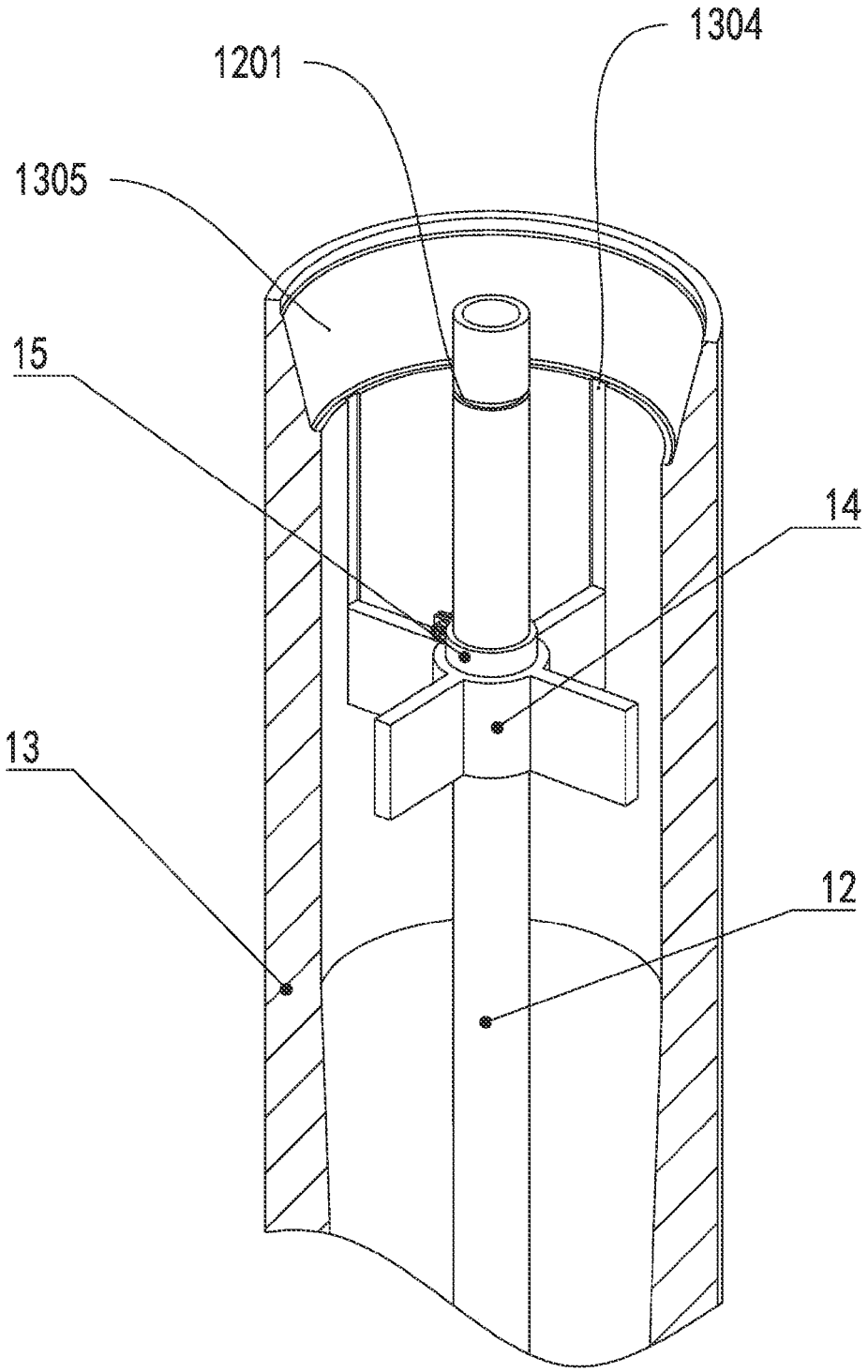
FIG. 9 is a partial sectional view of the spiral cyclone device for fine fraction in the present disclosure.

1 represents the sand discharge jet cylinder; 2 represents the spring I; 3 represents the sand discharge sliding sleeve; 4 represents the spring II; 5 represents the spring plate; 6 represents the conical flow stabilizing rubber cylinder; 7 represents the fixing ring I; 8 represents the positioning sleeve; 9 represents the cyclone generation plate; 10 represents the fixing ring II; 11 represents the cyclonic suction outer tube; 12 represents the hydraulic liquid tube; 13 represents the recovery cylinder for spirally crushed cements; 14 represents the centering bracket; 15 represents the fixing ring III; 101 represents the flat adapter threads I; 102 represents the sand discharge hole; 103 represents the male buckle taper threads; 104 represents the pipeline seal ring groove; 105 represents the groove; 106 represents the concave cone surface; 107 represents the jet threaded holes; 301 represents the sliding sleeve lower conical surface; 302 represents the lower steps I; 303 represents the sand discharge butting head; 304 represents the middle step II; 305 represents the sliding positioning cylinder section; 306 represents the sand collection chamber; 601 represents the rubber conical surface; 602 represents the labyrinth seal; 901 represents the flow baffle; 902 represents the circumferentially centering plate; 1101 represents the vortex trough; 1201 represents the hydraulic fluid ejection hole; 1301 represents the cyclonic auxiliary flow channel; 1302 represents the suction bowl connection threads; 1303 represents the tapered flow channel; 1304 represents the circumferential spline keyway; 1305 represents the drill rod female buckle threads.

DETAILED DESCRIPTION OF PREFERRED EMBODIMENTS

The various embodiments of the present application will be further described below with reference to the accompanying drawings.

According to at least one embodiment of the present disclosure, an in situ exploitation-separation-backfilling integration apparatus used for natural gas hydrates is provided, whose upper end is connected to a power drill and upper end is connected to a jet crushing head, comprising a cyclonic suction device for coarse fraction, a jet flow device for sand discharge and a spiral cyclone device for fine fraction; the jet flow device for sand discharge as a whole is located at the bottom end of the apparatus, the upper end of the jet flow device for sand discharge is connected to the cyclonic suction device for coarse fraction through screw threads, the cyclonic suction device for coarse fraction is connected to the lower end of the spiral cyclone device for fine fraction through screw thread.

Natural gas hydrates containing large amount of sands enters into the inner portion of the cyclonic suction outer tube 11 from the vortex trough 1101 at the upper portion of the swirling of the cyclonic suction outer tube 11 and flows through the cyclonic auxiliary flow channel 1301. Based on the centrifugation mechanism, cement sands move outwardly to the separated cylinder wall surface while lightweight natural gas hydrate in the fluid center is blocked by the cyclone generation plate 9 to generate upward cyclone. Meanwhile, taking advantage of "particle orbit motion" property of natural gas hydrates in the spiral cyclone device for fine fraction, the present invention can achieve effective separation of the micron-sized minuteness cement sand solid particles with cross-scale particle size in multi-phase mixed slurry, thereby ensuring the purity of natural gas hydrates returned from the exploitation process. Cement sands separated to the wall surface settle downwardly due to its own gravity and cement sands pass through the gap between the cyclone generation plate 9 and the cyclonic suction outer tube 11 and are stacked in the rubber conical surface 601 of the conical flow stabilizing rubber cylinder 6. When cement sands stacked on the rubber conical surface 601 reaches a certain weight, the rubber conical surface 601 is deformed under extrusion and cement sands fall into the sand collection chamber 306. When cement sands are accumulated in the sand collection chamber 306 to a certain amount, the gravity of cement sands pushes the sand discharge sliding sleeve 3 to slide downwardly so that the hydraulic liquid ejection hole 1201 will be opened to eject the hydraulic fluid. The hydraulic fluid under high pressure further pushes the sand discharge sliding sleeve 3 to slide downwardly until the concave cone surface 106 at the lower end of the sand discharge jet head 1 and the sliding sleeve lower conical surface 301 are overlapped, whereby the sand discharge butting head 303 and the sand discharge hole 102 are aligned. Cement sands and hydraulic fluids in the sand collection chamber 306 are discharged into the sea.

The in situ exploitation-separation-backfilling integration apparatus used for natural gas hydrates is in a double layer tube structure with the most inner layer being a hydraulic fluid tube 12;

The in situ exploitation-separation-backfilling integration apparatus used for natural gas hydrates is connected to natural gas water and exploitation tool tube string, whose lower end is connected to the dynamic drill and upper end is connected to the jet crushing head;

The cyclonic suction device for coarse fraction plays the role of preliminarily separating cement sands during the harvest process of natural gas hydrates, comprising the conical steady flow rubber cylinder 6, the fixing ring I 7, the positioning sleeve 8, the cyclone generation plate 9, the fixing ring II 10 and the cyclonic suction outer tube 11, the conical steady flow rubber cylinder 6 is fixed to the hydraulic liquid tube 12 using the fixing ring I 7 to play the role of stabilizing flow and controlling the one-way flow of fluid; the positioning sleeve 8 is mounted in the upper end of the fixing ring I 7 to axially fix the cyclone generation plate 9; the cyclone generation plate 9 is fixed to the upper end of the positioning sleeve 8 through the fixing ring II 10 of the cyclonic suction device for coarse fraction.

The jet flow device for sand discharge comprises the sand discharge jet cylinder 1, the spring I 2, the sand discharge sliding sleeve 3, the spring II 4 and the spring plate 5, wherein the lower end of the sand discharge sliding sleeve 3 abuts the spring I 2 and the upper end thereof abuts the spring II 4; the spring plate 5 fixes the spring I 2, he sand discharge sliding sleeve 3 and the spring II 4 inside the sand discharge jet cylinder 1; the sand discharge sliding sleeve 3 can slide downwardly under the gravity of cement sands and the lowest end of the hydraulic liquid tube 12 is assembled within the sand discharge jet cylinder 1. The jet flow device for sand discharge uses the gravity of cement sands to push the sand discharge sliding sleeve 3. Circumferential holes at the lower end of the hydraulic liquid tube 12 eject fluid of high pressure to discharge cement sands from the jet flow device for sand discharge;

The spiral cyclone device for fine fraction comprises the recovery cylinder for the spirally crushed cements 13, the centering bracket 14 and the fixing ring III 15, wherein the centering bracket 14 is fixed to the spirally crushed cements 13 through the fixing ring III 15 abutting the inner wall of the spirally crushed cements 13.

The upper end of the sand discharge jet cylinder 1 is configured with the flat adapter threads I 101, the lower end thereof is configured with the male buckle 103, it is circumferentially configured with the sand discharge hole 102 and its inner portion is configured with the groove 105 for receiving a spring. The concave cone surface 106 is adjacent to the groove 105. The inner layer of the sand discharge jet cylinder 1 has the pipeline seal ring groove 104 and the top end of the sand discharge jet cylinder 1 is configured with the jet threaded holes 107.

The sand discharge sliding sleeve 3 comprises the sliding sleeve lower conical surface 301 at the bottom end, the lower steps I 302 adjacent to the sliding sleeve lower conical surface 301, the sand discharge butting head 303 circumferentially configured on the sand discharge sliding sleeve 3, the middle step II 304 adjacent to the sand discharge butting head 303 and the sliding positioning cylinder section 305 at the upper most end of the sand discharge sliding sleeve 3, wherein the lower steps I 302 abuts the upper end of the spring I 2, the middle step II 304 abuts the spring II 4, the sliding positioning cylinder section 305 is in a clearance fit with the inner diameter of the spring plate 5 fixed to the jet threaded holes 107 through a bolt.

The conical flow stabilizing rubber cylinder 6 is a hollow conic shape made of rubber material, its rubber conical surface 601 deforms longitudinally under pressure, the lower end of the conical flow stabilizing rubber cylinder 6 is configured with a labyrinth seal 602.

The cyclone generation plate 9 comprises the flow baffle 901 at the upper portion, the circumferentially centering plate 902 at the lower portion and the through holes penetrating the flow baffle 901 and the circumferentially centering plate 902.

The cyclonic suction outer tube 11 is circumferentially distributed with the vortex trough 1101 at its upper portion and a circumferential speed is generated when fluid flows from the vortex trough 1101 into the cyclonic suction outer tube 11.

The hydraulic liquid tube 12 has the sand discharge hole 102 at the lower end to spray out hydraulic liquid and the tube wall of hydraulic liquid tube 12 is welded with the fixing step 1202 for axially fixing the cyclone generation plate 9.

The inner portion of the recovery cylinder for spirally crushed cements 13 from the bottom up is configured with the cyclonic auxiliary flow channel 1301 and the tapered flow channel 1303, and the outer portion thereof from the bottom up is configured with the suction bowl connection threads 1302, the circumferential spline keyway 1304 for positioning the centering bracket 14 and the drill rod female buckle threads 1305 at the uppermost end.

According to an embodiment of the present application, the upper end of the in situ exploitation-separation-backfilling integration apparatus used for natural gas hydrates is connected to jet sliding sleeve and the lower end thereof is connected to a dynamic tool.

According to one embodiment of the present application, the working process of the in situ exploitation-separation-backfilling integration apparatus used for natural gas hydrates is as follows:

The apparatus is the harvest separation portion of the exploitation tool tube string for natural gas hydrates, is connected to the jet crushing sliding sleeve for natural gas hydrates through the drill rod female buckle threads 1305, and is connected to the dynamic drill through the male buckle taper threads 103. The apparatus is put into the seabed with the exploitation tool tube string for natural gas hydrates, which can be applied to the fluidization exploitation method.

Specifically, firstly the tool tube string drills into the natural gas hydrate mineral layer, then the tool tube string is pulled back, at which time the jet crushing sleeve at the upper end of the tool tube string crushes natural gas hydrates and the crushed natural gas hydrates under high pressure and containing sands enter the cyclonic suction device for coarse fraction through the vortex trough 1101. Due to the function of the vortex trough 1101, natural gas hydrates containing sands generates a tangential velocity and the cyclonic auxiliary flow channel 1301 assists the flow to further generate tangential velocity flow. Under the function of centrifugal force, solid particles such as cement sands of greater mass are close to the inner wall of the cyclonic suction outer tube 11 and the fluid as a whole flows downward spirally. Fluid is blocked by the cyclone generation plate 9 and the outer ring flow is generated, for which reason cement sands of greater mass enter the sand collection chamber 306 from the gap between the inner wall of the cyclonic suction outer tube 11 and the cyclone generation plate 9. When cement sands in the sand collection chamber 306 are accumulated to a certain amount, the gravity of cement sands is larger than the elastic force of the spring I 2 and the sand discharge sliding sleeve 3 slides downwardly. The hydraulic fluid flows out from the hydraulic fluid tube 12 and discharges cement sands from the sand discharge jet cylinder 1.

What is claimed is:

1. An in situ exploitation-separation-backfilling integration apparatus for natural gas hydrates, which is configured as a double-layer tube structure and comprises a jet flow device for sand discharge, a cyclonic suction device for coarse fraction and a spiral cyclone device for fine fraction as an outer layer structure as a whole, and a hydraulic fluid tube (12) as an inner layer, wherein the whole jet flow device is located at the bottom end of the apparatus, an upper end of the jet flow device is connected to the cyclonic suction device through screw threads, the cyclonic suction device is connected to a lower end of the spiral cyclone device through screw threads;

the jet flow device comprises a sand discharge jet cylinder (1), a spring I (2), a sand discharge sliding sleeve (3), a spring II (4) and a spring plate (5), the lower end of the sand discharge sliding sleeve (3) abuts the spring I (2) and the upper end of the sand discharge sliding sleeve (3) abuts the spring II (4), the spring plate (5) seals the spring I (2), the sand discharge sliding sleeve (3) and the spring II (4) within the sand discharge jet cylinder (1), the sand discharge sliding sleeve (3) is configured to slide along the axial direction of the sand discharge jet cylinder (1), at least one portion of the hydraulic liquid tube (12) is configured to be assembled within the sand discharge jet cylinder (1);

the cyclonic suction device comprises a conical flow stabilizing rubber cylinder (6), a fixing ring I (7), a positioning sleeve (8), a cyclone generation plate (9), a fixing ring II (10) and a cyclonic suction outer tube (11), wherein, the conical flow stabilizing rubber cylinder (6) is fixed to the hydraulic liquid tube (12) through the fixing ring I (7), the positioning sleeve (8) is mounted on the upper end of the fixing ring I (7), the cyclone generation plate (9) is fixed to the upper end of the positioning sleeve (8) through the fixing ring II (10);

wherein, the spiral cyclone device comprises a recovery cylinder for spirally crushed cements (13), a fixing ring III (15) and a centering bracket (14) axially fixed to the inner wall of the recovery cylinder for spirally crushed cements (13) through the fixing ring III (15).

2. The apparatus according to claim 1, wherein the upper end of the sand discharge jet cylinder (1) is arranged with flat adapter threads I (101), the lower end of the sand discharge jet cylinder (1) is arranged with male buckle taper threads (103), the sand discharge jet cylinder (1) is circumferentially configured with a sand discharge hole (102), the inner portion of the sand discharge jet cylinder (1) is configured with a groove (105) and a concave cone surface (106) adjacent to the groove (105), the inner layer of the sand discharge jet cylinder (1) has a pipeline seal ring groove (104), the top end of the sand discharge jet cylinder (1) is configured with a jet cylinder threaded hole (107).

3. The apparatus according to claim 1, wherein the sand discharge sliding sleeve (3) from the bottom up comprises a sliding sleeve lower conical surface (301) at the bottom, a lower step I (302) adjacent to the sliding sleeve lower conical surface (301), a sand discharge butting head (303) circumferentially distributed at the sand discharge sliding sleeve (3), a middle step II (304), a sand collection chamber (306) at the inner portion of the sand discharge sliding sleeve (3) and a sliding positioning cylinder section (305) at the uppermost end of the sand discharge sliding sleeve (3), the lower step I (302) abuts the upper end of the spring I (2), the middle step II (304) abuts the spring II (4), the sliding positioning cylinder section (305) is in a clearance fit with the spring plate (5) fixed above the sand discharge sliding sleeve (3) through a bolt.

4. The apparatus according to claim 1, wherein the conical flow stabilizing rubber cylinder (6) is a hollow rubber cone made of rubber material, a rubber conical surface (601) of the conical flow stabilizing rubber cylinder (6) deforms longitudinally under pressure, the lower end of the conical flow stabilizing rubber cylinder (6) is integrally molded with a labyrinth seal (602).

5. The apparatus according to claim 1, wherein the cyclone generation plate (9) comprises a circumferentially centering plate (902) and a flow baffle (901) located at the upper portion of the circumferentially centering plate (902).

6. The apparatus according to claim 1, wherein the upper portion of the cyclonic suction outer tube (11) is circumferentially arranged with a vortex trough (1101), and a circumferential speed is generated when fluid flows into the vortex trough (1101).

7. The apparatus according to claim 1, wherein the lower end of the hydraulic liquid tube (12) is configured with a hydraulic fluid ejection hole (1201) for ejecting hydraulic fluid, the tube wall of the hydraulic liquid tube (12) is welded with a fixing step (1202) for axially fixing the cyclone generation plate (9).

8. The apparatus according to claim 1, wherein the outer wall of the recovery cylinder for spirally crushed cements (13) from the bottom up is configured with a suction bowl connection threads (1302), a circumferential spline keyway (1304) for positioning the centering bracket (14) and drill rod female buckle threads (1305), the inner portion of the recovery cylinder for spirally crushed cements (13) from the bottom up is configured with a cyclonic auxiliary flow channel (1301) and a tapered flow channel (1303).

* * * * *